United States Patent [19]

Rebel et al.

[11] Patent Number: 4,831,928

[45] Date of Patent: May 23, 1989

[54] MOUNTING FOR CHANGING APPLICATOR ROLLS OF PRINTING PRESSES

[76] Inventors: Herbert Rebel, Oberrodener Str. 112, 6054 Rodgau 3; Peter Hummel, Schlesie rstr. 13, 6050 Offenbach/Main, both of Fed. Rep. of Germany

[21] Appl. No.: 120,585

[22] Filed: Nov. 13, 1987

[30] Foreign Application Priority Data

Nov. 13, 1986 [DE] Fed. Rep. of Germany ..... 3638826

[51] Int. Cl.[4] ..... B41F 5/00

[52] U.S. Cl. ..... 101/216; 101/147; 101/348

[58] Field of Search ..... 101/348-352, 101/147, 148, 216

[56] References Cited

U.S. PATENT DOCUMENTS

| | | | |
|---|---|---|---|
| 3,259,060 | 7/1966 | Martin | 101/348 |
| 3,296,964 | 1/1967 | Orr | 101/348 |
| 3,556,005 | 1/1971 | Koch | 101/147 |
| 3,625,148 | 7/1971 | Muselik | 101/348 |
| 3,815,498 | 6/1974 | Harrod | 101/348 |
| 4,411,194 | 10/1983 | Davidson, Jr. | 101/216 |

*Primary Examiner*—Eugene H. Eickholt

[57] ABSTRACT

A mounting for changing or laterally reciprocatable inking, damping, or like applicator rolls of a printing press, which rolls are driven by a friction roll in engagement therewith. The changing applicator rolls each have their spindles mounted outside of the roll shell for rotational and axial movement in roller locks. Axial travel is limited by a shoulder ring in the roller lock, the ring cooperating with the outer race of a roller bearing which supports the roll spindle for relative rotational movement within the roller lock. Each roller lock also is mounted so as to be axially locatable in different positions for achieving desired axial movement of the applicator roll, or for preventing spreading movement of the applicator roll entirely.

10 Claims, 3 Drawing Sheets

22
25
26
28
29
30
31
35
36
38
39
40
45
46
48
50
51
52

MOUNTING FOR CHANGING APPLICATOR ROLLS OF PRINTING PRESSES

The present invention relates to mountings for changing or vibrator applicator rolls of printing presses.

Various mountings are known for permitting lateral reciprocating or vibrating movement of applicator rolls of printing presses. For example, German patent DE-PS No. 3 034644 describes an inking unit in which four applicator rolls are driven by way of gears by associated friction rolls and axial movement can be performed by way of a cam drum disposed at the axis of the rolls. The inking roll, which is the last roll in the ink supply path to the plate cylinder, is a changing or reciprocating roll for the purpose of improving mottling behavior of the inking unit. A disadvantage of such arrangement is that it is relatively costly, necessitating the addition of gears for driving the inking rolls, requiring the inking roll spindles to have rotatable and pivotal mountings at both ends, and requiring cams in the cam rolls in order to effect the lateral movement.

European patent application EP-A No. 0 143,240 discloses an inking unit employing simpler means for oviating mottling of the printing plate or print image. The changing or reciprocating inking roll in this instance performs asynchronous lateral movement relative to a friction roll from which the applicator roll drive movement is derived by friction. The shell of the changing inking roll is mounted for rotation and axial displacement in a co-rotating roll spindle disposed in mountings, the axial travel being limited at both ends by collars or bushings between which a compression spring is provided on each side of the roll. A disadvantage of this arrangement is that the axial movement of the changing roll cannot be easily adjusted to accommodate the particular matter being printed. Also, the lateral movement cannot be rendered completely inoperative, even though reciprocation of the applicator roll often is unneeded and creates unnecesssary wear.

Also known in the art is a so-called anti-mottling roll whose axial travel is adjustable and which is driven by a friction roll in engagement therewith. The anti-mottling roll is disposed in existing roller locks, instead of the inking roll that is the last roll in the ink path to the plate cylinder. While axial travel of the anti-mottling roll is adjustable, it cannot be made inoperative. Another disadvantage of such anti-mottling roll, as with each of the forgoing types of changing rolls, is that a special roll design in necessary for each individual use since there must always be engagement of the roll shell for the inking rolls in order to effect axial travel.

It is an object of the present invention to provide a relatively simple and more versitile mounting for changing, axially reciprocal applicator rolls of a printing press.

Another object is to provide a roll mounting as characterized above that permits easy adjustment of the axial travel of the changing roll so as to be adaptable for preventing streaking in different subjects being printed.

A further object is to provide a mounting for changing applicator rolls of printing presses that enables any existing applicator rolls driven frictionally by a friction roll in engagement therewith to be easily provided with axial ink spreading travel and which can be brought into and out of operative engagement without the need for moving the roll spindle axially and without the need for engaging the roll shell.

Yet another object is to provide a changing roll mounting of the above kind in which changing or ink spreading movement of the applicator roll can be selectively rendered inoperative with relative ease.

Still another object is to provide a changing roll mounting of such type which lends itself to easy service.

Other objects and advantages of the invention will become apparent upon reading the attached detailed description and upon reference to the drawings, in which.

Figure 1:
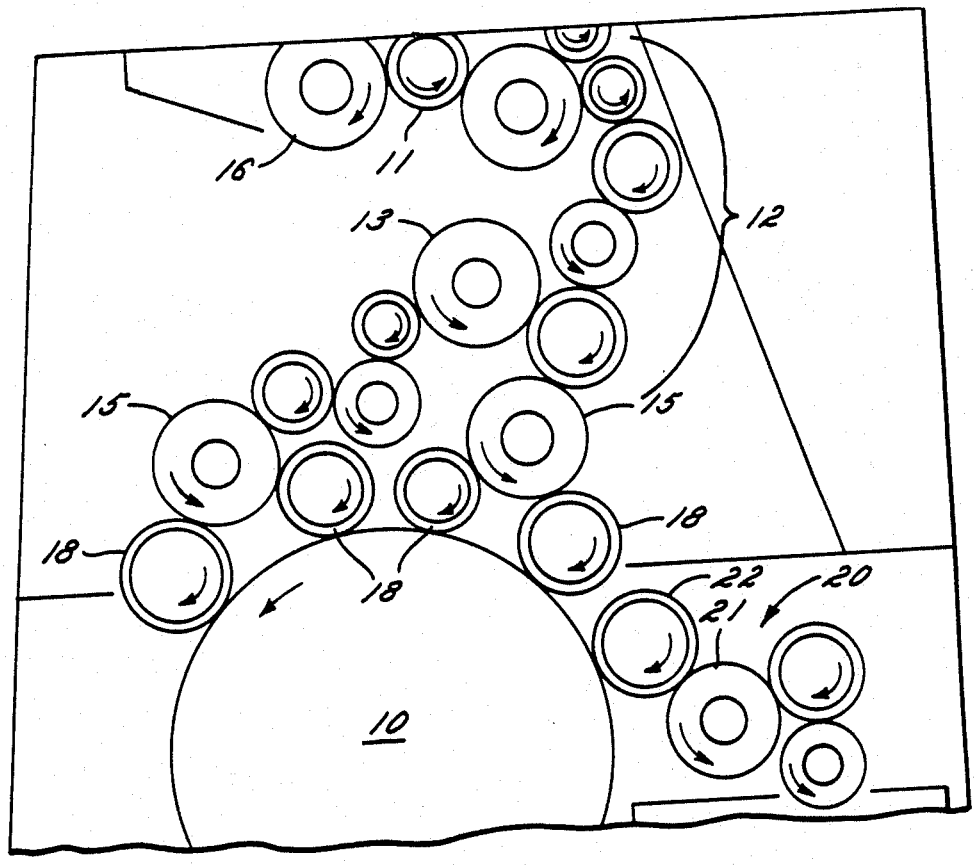
FIG. 1 is a schematic elevation of an inking unit in an offset printing press employing the present invention.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

Turning now to FIG. 1, there is shown schematically, and in elevation, an inking unit consisting of a series of film forming rollers characteristic of a modern lithographic press for supplying ink to a plate cylinder 10. A source of ink is provided in the form of a fountain 16 from which ink is feed by a doctor roll 11 through a series of transfer rolls 12 including an ink drum 13 and a pair of friction rolls 15.

Interposed between the friction rolls 15 and the plate cylinder 10 of the press are paired inking rolls 18, which occupy the further downstream position in the ink flow path. For applying a damping agent to the plate cylinder 10, a damping unit 20 is provided which includes a friction roll 21 and a damping roll 22 interposed between the friction roll 21 and the plate cylinder 10. For purposes herein, the inking rolls 18 and damping roll 22, which are adapted for engagement with the plate cylinder 10, are referred to as applicator rolls.

As thus far described, the operation of the inking unit is conventional, the ink fountain roller 16 and various of the transfer rollers 12, including the drum 13 and friction rollers 15 being directly coupled to the press drive which operates the cylinders of the press. The friction rollers 15, in addition to being rotatable, are laterally movable by conventional vibrator drive means.

Figure 2:
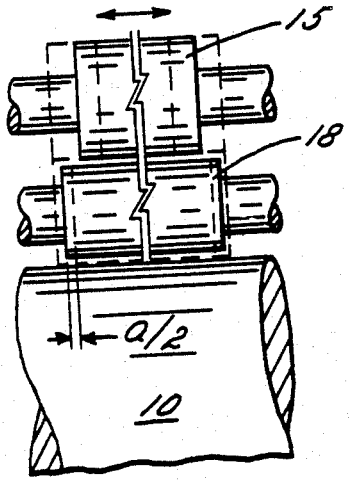
FIG. 2 is a diagrammatic view showing the relation of the friction roll to one of the applicator rolls and depicting lateral movement of each in phantom.

The inking rolls 18 and damping roll 22 are adapted for spreading ink or a damping agent, respectively, laterally by reciprocating or axial movement, the roll shells being driven by frictional engagement by the co-operating friction rollers 15, 21 as shown in FIG. 2.

When the friction rolls 15, 21 move laterally, the inking rolls 18 and the damping roll 22 follow the respective friction roll over the distance a and remain in their respective end positions until the friction rolls 15, 21 reverse their movement at their dead center positions. The inking rolls 18 and damping roll 22, therefore, move laterally in synchronism with the friction rolls.

For selectively disengaging the inking rolls 18 and the damping roll 22 from the plate cylinder 10 to interrupt printing, the applicator rolls 18, 22 each are disposed in a pivotable mounting 25, which may be of a known type. It will also be understood that the plate cylinder and its associated blanket cylinder may be devised in a known manner to disengage from one another so that their generated surfaces cease to contact each other.

Figure 4:
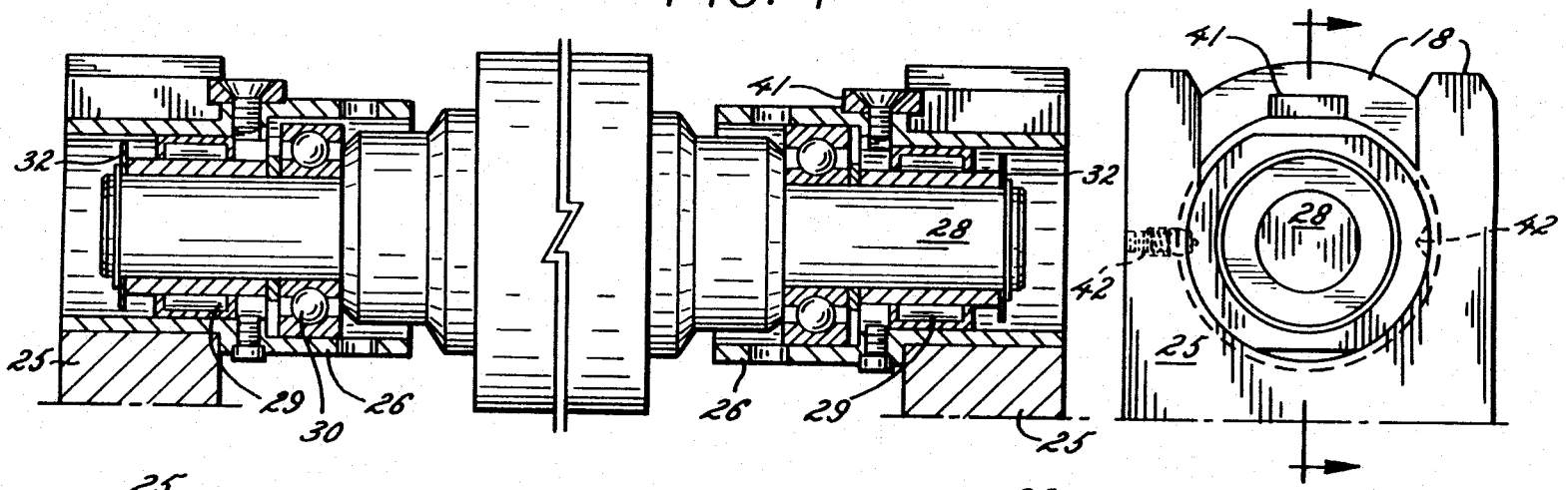
FIG. 4 is a partial section, similar to FIG. 3, showing ink spreading function in operative condition, with the changing inking roll disposed at a central location.
Figure 3:
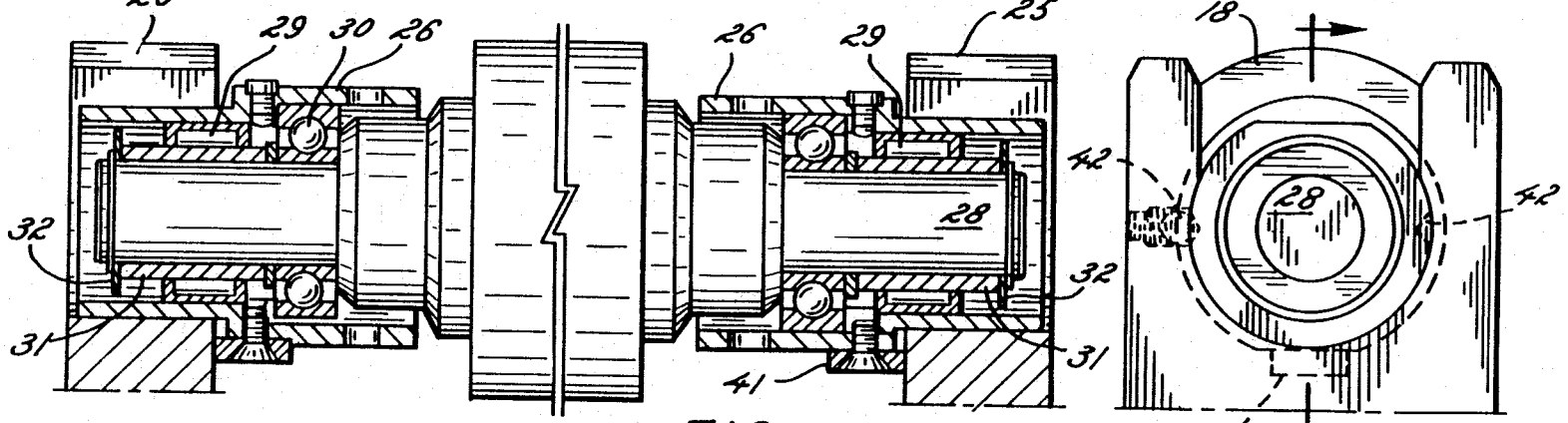
FIG. 3 is a partial section through one of the changing inking rolls illustrating the mounting arrangement of the present invention, with the ink spreading function being inoperative.

In accordance with the invention, at least some of the applicator rolls are disposed in their respective pivot mounting for selective lateral reciprocating movement, without the need for a special roll design for the particular lateral spreading, as has heretofore been required. To this end, the inking rolls 18 and damping roll 22 each are mounted within their pivotable mounting 25 by anti-mottling roller locks 26. The applicator rolls 18, 22 have their spindles 28 journaled in the roller locks 26 outside the roll shell for permitting both rotational and axial movement of the rolls 18, 22. For this purpose, the spindles 28 of the applicator rolls 18, 22 each are supported in a needle bearing 29 and a roller bearing 30 disposed in adjacent side by side relation in the roller lock 26, the needle bearing 29 having an elongated internal collar 31. In the case of the inking rolls 18, the inner race of the roller bearing 30 and the elongated internal collar 31 of the needle bearing 29 are secured by means of annular clips 32, as shown in FIGS. 3 and 4, mounted on the respective spindle 28 of the inking rolls in axially spaced relation to the end of the roller shell. In the case of the damping roll 22, as shown in FIGS. 5 and 6, a cover plate 35 is mounted at the end of the spindle 28, being secured there by a screw 36, and a shoulder ring 38 is mounted on the spindle on the opposite side of the needle bearing 29 and roller bearing 30.

Rotation and displacement of the roller locks 26 enables axial travel of the applicator rolls 18, 22 to be adjusted and axial movement to be rendered inoperative, depending upon print order requirements. Axial travel of the applicator rolls is limited by a shoulder 39 of the roller lock 26, which engages an outer race 40 of the roller bearing 30.

A step wise radial locking arrangement for the inking rolls 18, is illustrated in FIGS. 3 and 4. The radial locking arrangement in this instance comprises an abutment 41 on the roller lock 26 and a ball catch 42 in the mounting 25 which cooperates with respective grooves 42 in the roller lock. By displacing and adjusting the roller lock through 180° the abutment 41 and a groove 42 can be moved step wise into disengagement position shown in FIG. 3, which renders the lateral movement inoperative, and into a changing position, shown in FIG. 4, wherein the inking roll 18 is shown in a central position for maximum travel, a distance "a". Alternatively, two other changing positions, each having a travel of one half the distance "a" may be set by alternative rotation of the left and right abutments 41. In other words, in the embodiments of FIGS. 3 and 4, each abutment 41 is selectively positionable for permitting movement of the applicator roll 18 in an axial direction through one half the distance "a". When the abutments 41 at both ends are moved to the positions shown in FIG. 4, maximum travel, or the entire distance "a", may be laterally transgressed by the applicator roll 18.

Figures 5, 6:
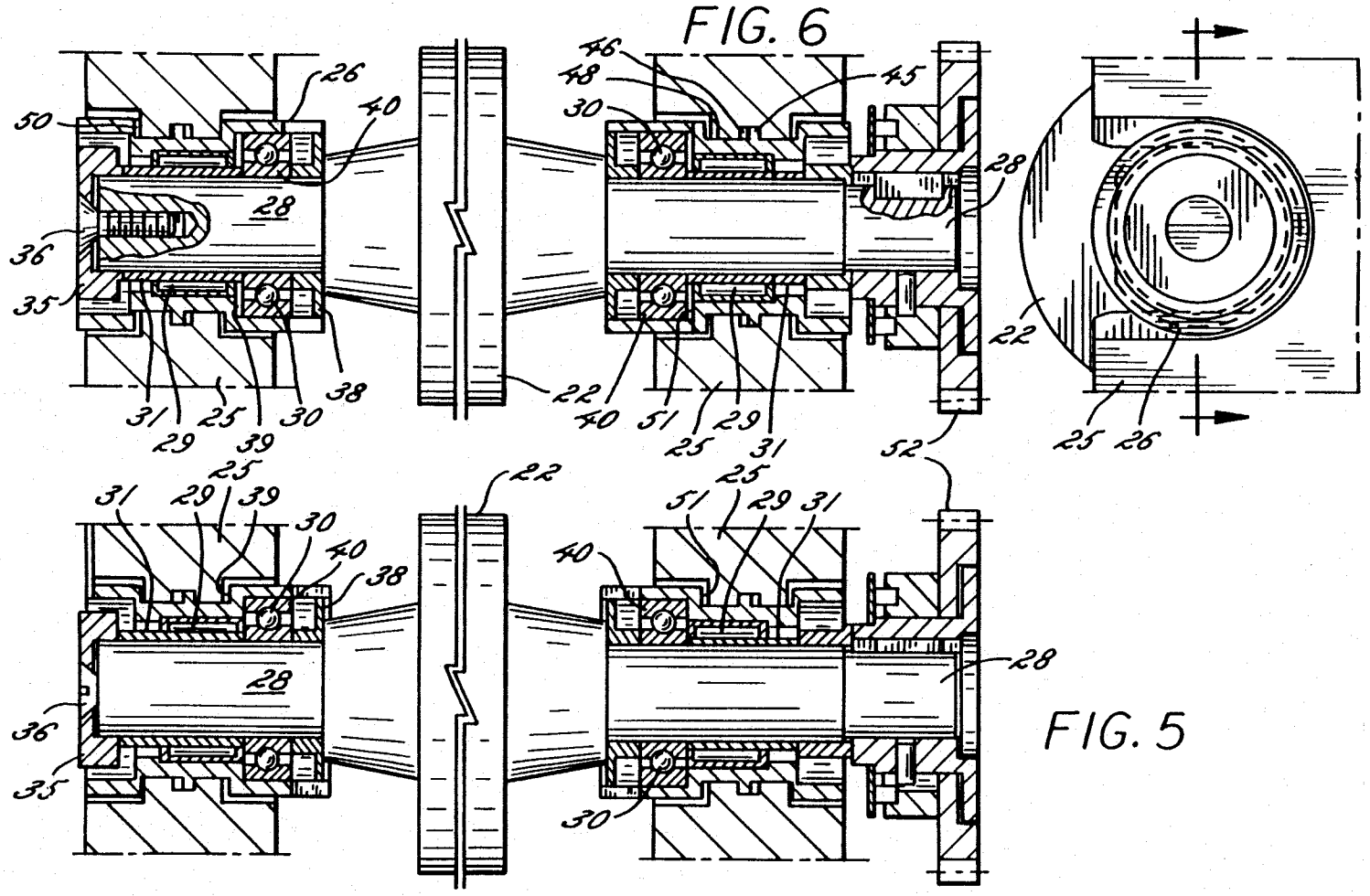
FIG. 5 is a partial longitudinal section through a changing damping roll with a mounting pursuant to the invention, showing the spreading function in inoperative condition.
FIG. 6 is a longitudinal section, similar to FIG. 5, showing the spreading function in operative condition with the damping roll in a central location.

An alternative radial locking arrangement is shown for the damping roll shown in FIGS. 5 and 6. In this instance, the locking arrangement is adapted to locate the roller lock in a self-locking position to prevent axial movement of the damping roll, and to enable axial movement to be adjusted to any position between the inoperative and a maximum limit. To this end, an acentric clamping protrusion 45 is provided on the roller lock 26 which extends into and cooperates with a concentric groove 46 in the mounting. The bore 48 in the mounting likewise is concentric. In FIG. 5, the locking arrangement is shown rendering lateral movement of the damping roll inoperative, while in FIG. 6 illustrates the locking arrangement in a position which permits operation of the spreading function of the damping roller, with the damping roll shown in a central position of its changing lateral travel "a". A gap 50 in FIG. 6 in this case is greater than "a" in order that an axial clearance may be provided to enable maximum travel "a" between the shoulder 51 and the outer race 40 to be easily adjusted. It will be understood that except for the locking arrangement, the mounting of FIGS. 5 and 6 is otherwise substantially similar to that shown in FIGS. 3 and 4. In FIG. 6, a drive 52 for the damping roll 22 is a slip clutch, although other known means may be provided.

An important advantage of the invention is that all that is necessary is for existing inking or varnishing or damping rolls to be made into a changing applicator roll is for their journals introduced into anti-mottling roller locks 26 according to the invention. Hence, any press can be readily modified, without the necessity for a special roll design. Since axial movement of the ink-spreading roll can be adjusted steplessly or stepwise, subject-dependent streaks can be eliminated, with better adaptation to the subject, than in ink-spreading drives which have no provision for adjustment of their travel. The reduced and, as it were, intermittent travel of the changing rolls reduces wear of the printing plate or blanket cylinder. The adjustment of travel can also render completely inoperative in a simple way the ink-spreading function of the charging rolls. The anti-mottling roller locks can be actuated by way of known adjusting mechanisms either manually or automatically and whether or not the press is running, so as to permit ease of service of the adjustment.

It will be understood that the roller locks can be actuated manually or can be mechanized or automated, for example, in association with known adjusting drives. The roller locks can be actuated whether or not the press is running.

From the foregoing, therefore, it can be see that the roller locks may be used for any applicator rolls, for example, damping, inking or varnishing rolls; and one or more rolls can readily be equipped with the roller locks. The resulting spreading effect of the applicator roll obviates streaking caused by the agents used building up the damping, inking or varnishing units because of irregular consumption on the plate or blanket. The spreading, which can be produced quite simply by friction provided by existing friction roll drive, can be adjusted to a particular travel or rendered completely inoperative without additional expense.

We claim as our invention:

1. In a printing press having a frame and a press drive, the combination comprising, a plate cylinder journaled in said frame, at least one applicator roll adapted for engagement with said plate cylinder, means supporting said applicator roll for axial and rotational movement, a rotatable friction roll engageable with said applicator roll for driving said applicator roll, said friction roll being axially movable for moving said applicator roll for imparting lateral reciprocating movement to said applicator roll for oviating mottling behavior on said plate cylinder, said applicator roll mounting means including a pivotable mounting supported by said press frame, roller locks disposed in said pivotal mounting, said applicator roll having spindles at opposed ends thereof journaled in respective of said roller locks for relative rotational movement, and said roller locks being journaled in said pivotable mountings for selective axial positioning relative to the pivotable mounting for limiting axial movement of the applicator roll journaled therein.

2. In the printing press of claim 1 in which said applicator roll is an inking roll, and an inking unit for supplying ink to said inking roll.

3. In the printing press of claim 1 in which said applicator roll is a damping roll, and a damping unit for supplying a damping agent to said damping roll.

4. In the printing press of claim 1 in which said locking roll is adapted for stepped axial adjustment, and radial locking means in said pivotable mounting for engaging said locking roll and retaining it in a selected stepped position.

5. In the printing press of claim 1 in which said applicator roll mounting means includes a needle bearing having an elongated collar and an adjacently disposed roller bearing which support each roll spindle in its respective roller lock.

6. In the printing press of claim 4 in which said radial locking means includes an abutment on each said roller lock, ball catch engaging means carried by said pivotable mounting, and said roller lock being formed with grooves for receiving said ball catch in a selectedly adjusted position.

7. In the printing press of claim 1 including radial locking means for securing said roller locks in selected adjusted positions.

8. In the printing press of claim 7 in which said pivotable mountings each are formed with a groove concentric with the applicator roll, and said radial locking means includes an accentric clamping protrudence that cooperates with said groove.

9. In the printing press of claim 5 in which said roller bearing has inner and outer races, and said roller locks each are formed with a shoulder ring that is engagable with an outer race of a respective one of said roller bearings for limiting axial movement of said roller lock.

10. In the printing press of claim 1 in which said roller locks are adjustable for preventing axial movement of said applicator roll.

* * * * *

UNITED STATES PATENT AND TRADEMARK OFFICE

CERTIFICATE OF CORRECTION

PATENT NO. : 4,831,928

DATED : May 23, 1989

INVENTOR(S) : Herbert Rebel and Peter Hummel

It is certified that error appears in the above-identified patent and that said Letters Patent is hereby corrected as shown below:

ON THE TITLE PAGE INSERT:

-- [73] Assignee: MAN Roland Druckmaschinen AG, Fed. Rep. of Germany --.

Signed and Sealed this

Sixteenth Day of January, 1990

*Attest:*

JEFFREY M. SAMUELS

*Attesting Officer*

*Acting Commissioner of Patents and Trademarks*